United States Patent [19]

Meyenschein

[11] 4,315,604

[45] Feb. 16, 1982

[54] MEAT GRINDER WITH MEANS FOR SEPARATING GRISTLE FROM THE GROUND MEAT

[75] Inventor: Richard Meyenschein, Schriesheim-Altenbach, Fed. Rep. of Germany

[73] Assignee: Christ KG, Schriesheim-Altenbach, Fed. Rep. of Germany

[21] Appl. No.: 146,691

[22] Filed: May 5, 1980

[30] Foreign Application Priority Data

May 14, 1979 [DE] Fed. Rep. of Germany ..... 2919321

[51] Int. Cl.[3] ..... B02C 18/36

[52] U.S. Cl. ..... 241/82.5; 17/1 G

[58] Field of Search ..... 241/82.1-82.7; 17/1 G, 46

[56] References Cited

U.S. PATENT DOCUMENTS

| | | | |
|---|---|---|---|
| 2,924,257 | 2/1960 | Reid, Sr. | 241/82.5 |
| 3,362,044 | 1/1968 | Irving | 241/82.1 X |
| 4,153,208 | 5/1979 | Vomhof et al. | 241/82.4 |
| 4,202,502 | 5/1980 | Laska | 241/82.5 |

FOREIGN PATENT DOCUMENTS

| | | | |
|---|---|---|---|
| 2809609 | 9/1979 | Fed. Rep. of Germany | 241/82.5 |

*Primary Examiner*—James G. Smith

*Attorney, Agent, or Firm*—Kurt Kelman

[57] ABSTRACT

A meat grinder has an arrangement for separating gristle and the like from the meat to be ground. The arrangement comprises an apertured discharge disc for the ground meat defining an axial bore having a threaded cylindrical portion and an adjoining funnel portion, a rotary cutter comprising a separating knife having a plurality of radial cutter blades in axial alignment with the disc and including oblique cutting edges adjacent the input side of the disc and arranged to convey the gristle towards the axial bore, and a separating casing which includes an annular threaded portion engaging the threaded cylindrical portion of the axial bore for threadedly mounting the casing in the bore for axial adjustment in relation thereto, and an adjoining separating head conforming to the funnel portion of the bore. The annular threaded portion defines at least one separating aperture adjacent the head.

7 Claims, 2 Drawing Figures

Figures 1, 2:
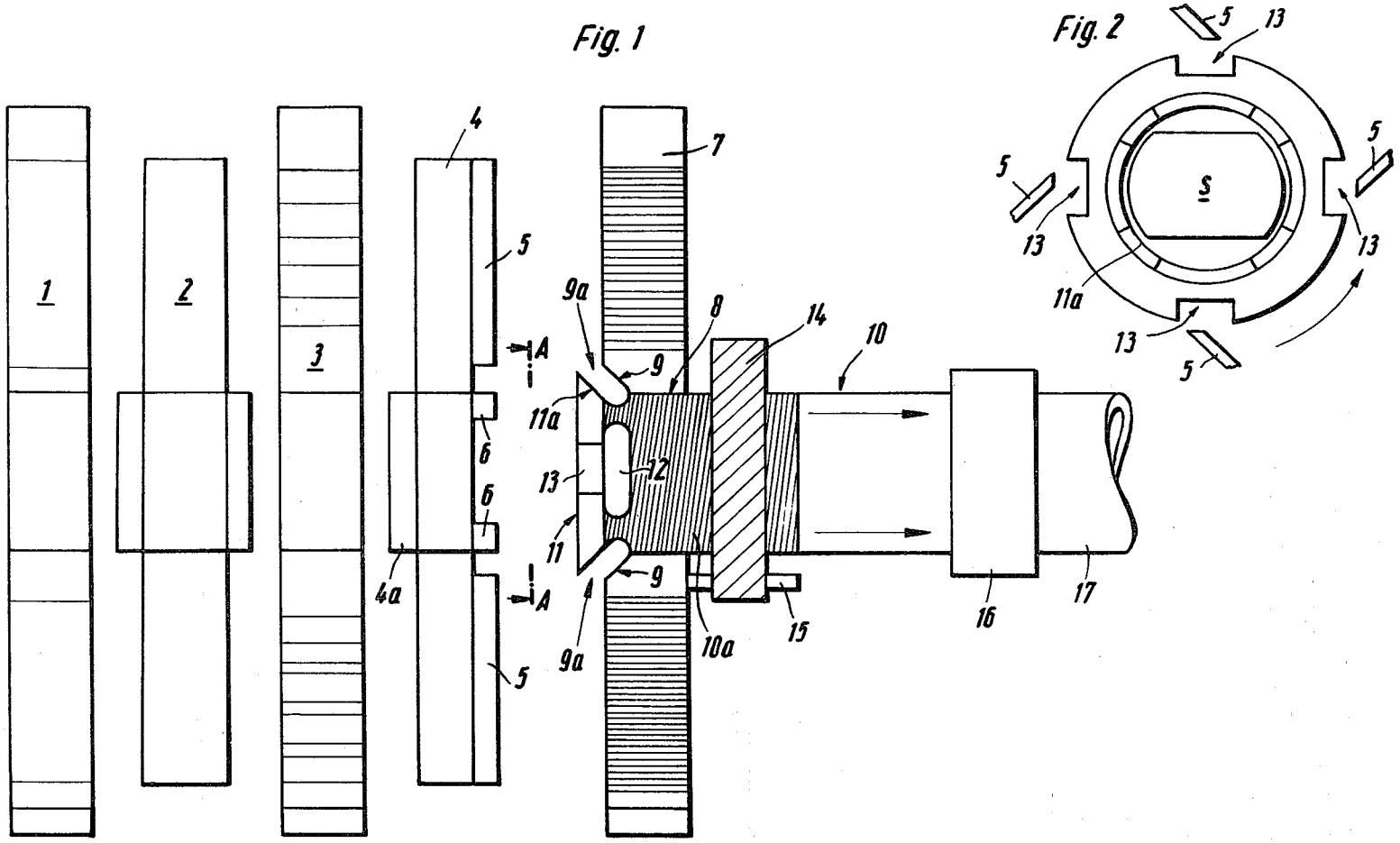

S
5
13
11a
17
16
10
14
15
10a
7
8
9
12
9a
11
4
6
4a
3
2
1
A

MEAT GRINDER WITH MEANS FOR SEPARATING GRISTLE FROM THE GROUND MEAT

The present invention relates to means in a meat grinding device for separating gristle, sinews and like tough material from the meat to be ground.

Conventional meat grinding devices, in their simplest construction, comprise an apertured discharge disc for the ground meat and a rotary cutter means comprising a knife in axial alignment with the disc and adjacent an input side thereof, an extrusion screw conveying the meat to be ground to the knife and the screw having an axially extending plug to which the knife is keyed for rotation with the screw. The cutting edges of the knife blades engage the input side of the disc and, during rotation of the knife, the meat is minced or ground and the soft ground meat is discharged through the apertures of the disc. Any gristle, sinews, small bones and like tough material in the meat interfere with the grinding process since they are not comminuted by the rotary engagement of the knife blades with the input side of the discharge disc and do not pass through the disc apertures but remain on the input side and are dragged along by the rotating knife. In this manner, they tend to clog the disc apertures and reduce the efficiency of the meat grinder.

Furthermore, for many purposes, such as the preparation of high-quality sausages, it is desirable to discharge from the grinder only pure meat containing none of the tough material. If it is not removed during grinding, the butcher must separate this material from the ground meat in a time-consuming operation which is not always fully successful.

For this reason, various means have been proposed in meat grinding devices for separating gristles, sinews and like tough material from the meat to be ground. For instance, Published German Patent Application No. 2,344,284 discloses a meat grinding device wherein the input side of the apertured discharge disc for the ground meat defines grooves enclosing acute angles with the direction of rotation of the knife. The shearing effect of the knife separates the tough material from the soft meat and this tough material is dragged along by the rotating knife and pressed into the grooves which, in turn, lead the tough material into an axial bore in the discharge disc while the ground soft meat is discharged through the apertures in the disc. To facilitate the discharge of the tough material through the central bore in the disc, the wall of the bore defines grooves matching the grooves in the input side of the disc and constituting their continuation. Spiral grooves in the hub of the knife complement the grooves in the bore of the disc and the knife hub is plugged into a discharge device through which the tough material is pressed.

This arrangement is not only expensive but also has various operational disadvantages. For example, the tough material may be pressed out of the grooves in the input side of the discharge disc and such excess material may still clog the apertures of the disc on its way into the central bore. Also, experience has shown that larger bore portions accumulating in the specially designed grooves in the input side of the disc are frequently subjected to such strong shearing forces by the rotating knife that they are sufficiently comminuted on their way to the central bore that they mingle with the minced meat and pass through the apertures of the discharge disc. On the other hand, soft meat portions are sometimes pressed into the grooves with the tough material, leading to meat losses.

In addition, grinding conditions depend on the nature of the meat to be ground, i.e. whether it contains more or less tough material, such as gristle, sinews, bones and the like. No adjustment to such different types of meat is possible with the above-described meat grinding device.

It is the primary object of this invention to provide improved means for separating tough material from meat to be ground in a meat grinding device and which is adjustable for most effective operation with different types of meat.

The above and other objects are accomplished according to the invention with the combination of an apertured discharge disc for the ground meat having an input side and an output side, the disc defining an axial bore having a threaded cylindrical portion and an adjoining funnel portion outwardly tapering in the direction of the input side, rotary cutter means comprising a separating knife having a plurality of radially extending cutter blades in axial alignment with the disc, the knife including obliquely extending cutting edges adjacent the input side of the disc and arranged to convey the tough material towards the axis bore, and a separating casing. The casing includes an annular threaded portion engaging the threaded cylindrical portion of the axial bore for threadedly mounting the casing in the bore for axial adjustment in relation thereto, and an adjoining outwardly flaring separating head conforming to the funnel portion of the bore, the annular threaded portion defining at least one separating aperture adjacent the head.

The funnel portion of the bore and the conforming separating head are preferably frusto-conical and they are arranged to define therebetween a gap leading laterally inwardly to the separating aperture, the size of the gap being adjustable to match the size of the aperture upon the axial adjustment of the casing in relation to the axial bore in the disc. In this way, the gap may be readily adjusted to the nature of the tough material to be separated and this material will pass through the gap into the aperture whence it enters the interior of the casing for removal. This arrangement is comparable to an adjustable valve which may be readily adjusted between a fully opened and fully closed position, and all positions therebetween, depending on the size of the gap and simply by screwing the casing into and out of the axial bores. The aperture or apertures in the wall of the casing receives or receive the tough material through the gap, the material moving radially inwardly into the interior of the casing. If the quality of the meat is poor, i.e. the meat contains about 20% tough material, the valve opening is increased to enable this material to be removed therethrough. On the other hand, if high-quality meat is ground, which contains only about 1% cartilage, the valve opening is reduced correspondingly. The size of the pieces of meat fed into the grinding device is always the same, the changes occurring only in connection with the quality of the meat to which the gap is adjusted. In this manner, meat of a lower quality can be so ground that the resultant ground meat has the same quality as one obtained from high-quality meat. The separating capacity can be adjusted to different types of meat so that any meat can be used with an optimal result by a very simple adjustment.

The above and other objects, advantages and features of the present invention will become more apparent from the following detailed description of a now preferred embodiment thereof, taken in conjunction with the accompanying highly schematic drawing wherein FIG. 1 is a side elevational view, partly in section, of the discharge end of a meat grinding device, showing only the combination of the rotary cutter means, the apertured discharge disc for the ground meat and the separating casing in accordance with this invention, and FIG. 2 is an end view of the separating casing, seen in the direction of arrows A—A of FIG. 1.

Referring now to the drawing, which omits conventional parts of a meat grinding device including the usual axially extending extrusion screw with its axial stub to which the rotary cutter means is keyed for rotation therewith and the tubular housing which encases the screw and cutter means and on whose outer end the apertured discharge disc is mounted, there is shown a rotary cutter means comprising coarse cutter 1, conveying knife 2, perforated disc 3 for passing coarsely cut meat and separating knife 4 having a plurality of radially extending cutter blades. Knife 4 is in axial alignment with apertured discharge disc 7 for the ground meat. Cutter 1, knife 2 and knife 4 are keyed to stub or drive shaft S (FIG. 2) of the conveying screw for rotation therewith and discs 3 and 7 are also axially aligned therewith, having axial bores receiving the stub or drive shaft. Knife 4 has collar 4*a* at the hub thereof which fits in the central bore of disc 3 and obliquely extending cutting edges 5 adjacent the input side of disc 7 and arranged to convey tough material towards axial bore 8 defined in disc 7.

All of the above-described structure is more or less conventional in meat grinding devices. According to the invention, axial bore 8 defined in apertured discharge disc 7 has a threaded cylindrical portion and adjoining funnel portion 9 outwardly tapering in the direction of the input side of the disc. This invention furthermore provides separating casing 10 including annular threaded portion 10*a* engaging the threaded cylindrical portion of axial bore 8 for threadedly mounting casing 10 in bore 8 for axial adjustment in relation thereto. Casing 10 also includes adjoining outwardly flaring separating head 11 whose wall 11*a* conforms to funnel portion 9 of bore 8. The annular threaded portion of casing 10 defines at least one separating aperture 12, four such apertures being illustrated herein distributed equidistantly around the circumference on the threaded casing portion. As best shown schematically in FIG. 2, obliquely extending cutting edges 5 of knife 4 are arranged to convey the tough material towards axial bore 8 in the direction of rotation of the knife.

While the flare of funnel portion 9 and wall 11*a* of head 11 may take any desired shape, they are illustrated herein to be frusto-conical. They always must conform to each other.

The funnel portion and the conforming separating head are arranged to define therebetween gap 9*a* leading laterally inwardly to separating aperture 12, the size of the gap being adjustable upon the axial adjustment of casing 10 in relation to axial bore 8 in disc 7.

As best shown in FIG. 2, the preferred separating head illustrated herein has a rim defining a plurality of grooves 13 spaced around the circumference of the rim and cooperating with respective ones of cutting edges 5 to constitute a grinding station in which any pieces of gristle too large to pass through apertures 12 are comminuted so as to be able to enter through the apertures into the interior of casing 10.

Separating casing 10 is threadedly engaged with axial bore 8 of disc 7 during assembly, with separating head 11 facing knife 4. The annular threaded portion 10*a* extends axially beyond the output side of discharge disc 7 and nut 14 is threadedly engaged with the threaded portion which extends beyond the output side of the disc for axially fixing discharge disc 7 and casing 10 in relation to each other. Since nut 14 may become very tight, hollow screw 15 is inserted in the nut for holding the nut in position. When the nut is tightened, it presses against discharge disc 7. By removing screw 15, all parts may be readily disassembled.

As shown in the preferred embodiment shown herein, discharge tube connector 16 is mounted at an end of casing 10 remote from annular threaded portion 10*a* thereof and this connector mounts tube 17 on casing 10. In this manner, the tough material separated from the soft ground meat, which is discharged through the apertures in disc 7, and received through gap 9*a* and apertures 12 in the interior of casing 10 is removed from the meat grinding device through tube 17.

As shown, lugs 6 project from collar 4*a* of knife 4 towards separating head 11 and cooperate with stub or drive shaft S to close off axial access into casing 10 through the separating head.

In FIG. 1, the axial adjustment of separating casing 10 in relation to ground meat discharge disc 7 is such that gap 9*a* is at its widest, i.e. the "valve" is completely open. By turning the casing, the gap and apertures 12 are gradually reduced until the "valve" is completely closed when wall 11*a* of the separating head contacts funnel portion 9. In this axial position, the separating means is non-operative. The size of the gap and separating apertures are thus readily adjustable to the quality of the meat to be ground, i.e. the type and amount of tough material to be separated.

What is claimed is:

1. Means in a meat grinding device for separating gristle, sinews and like tough material from the meat to be ground, which comprises the combination of (a) an apertured discharge disc for the ground meat having an input side and an output side, the disc defining (1) an axial bore having a threaded cylindrical portion and an adjoining funnel portion outwardly tapering in the direction of the input side, (b) rotary cutter means comprising a separating knife having a plurality of radially extending cutter blades in axial alignment with the disc, the knife including (1) obliquely extending cutting edges adjacent the input side of the disc and arranged to convey the tough material towards the axial bore, and (c) a separating casing including (1) an annular threaded portion engaging the threaded cylindrical portion of the axial bore for threadedly mounting the casing in the bore for axial adjustment in relation thereto, and (2) an adjoining outwardly flaring separating head conforming to the funnel portion of the bore, (3) the annular threaded portion defining at least one separating aperture adjacent the head.

2. The means of claim 1, wherein the funnel portion of the bore and the conforming separating head are frusto-conical.

3. The means of claim 1 or 2, wherein the funnel portion and the conforming separating head are arranged to define therebetween a gap leading laterally to the separating aperture, the size of the gap being adjustable upon the axial adjustment of the casing in relation to the axial bore in the disc.

4. The means of claim 1 or 2, wherein the separating head has a rim defining a plurality of grooves spaced around the circumference of the rim.

5. The means of claim 1 or 2, wherein the annular threaded portion of the separating casing extends axially beyond the output side of the discharge disc, and further comprising a nut threadedly engaged with the threaded portion which extends axially beyond the output side for axially fixing the discharge disc and the casing in relation to each other.

6. The means of claim 5, further comprising a hollow screw holding the nut in position.

7. The means of claim 1 or 2, further comprising a discharge tube connector mounted at an end of the casing remote from the annular threaded portion thereof.

* * * * *